US011710933B2

(12) United States Patent
Maesoba et al.

(10) Patent No.: US 11,710,933 B2
(45) Date of Patent: Jul. 25, 2023

(54) TERMINAL MODULE, AND CONNECTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 212 days.

(21) Appl. No.: 17/417,542

(22) PCT Filed: Dec. 20, 2019

(86) PCT No.: PCT/JP2019/050101
§ 371 (c)(1),
(2) Date: Jun. 23, 2021

(87) PCT Pub. No.: WO2020/137886
PCT Pub. Date: Jul. 2, 2020

(65) Prior Publication Data

US 2022/0052494 A1 Feb. 17, 2022

(30) Foreign Application Priority Data

Dec. 28, 2018 (JP) ..... 2018-247605

(51) Int. Cl.
*H01R 13/00* (2006.01)
*H01R 13/6592* (2011.01)
(Continued)

(52) U.S. Cl.
CPC ..... *H01R 13/6592* (2013.01); *H01R 9/03* (2013.01); *H01R 13/40* (2013.01); *H01R 13/65912* (2020.08)

(58) Field of Classification Search
CPC ..... H01R 13/6592; H01R 9/03; H01R 13/40; H01R 13/65912
See application file for complete search history.

(56) References Cited

U.S. PATENT DOCUMENTS 5,180,316 A 1/1993 Miller et al.
5,911,599 A 6/1999 Masuda
(Continued)

FOREIGN PATENT DOCUMENTS

EP 3336970 A1 6/2018
JP 2011-253724 A 12/2011

OTHER PUBLICATIONS

International Search Report dated Mar. 10, 2020 for WO 2020/137886 A1 (4 pages).

*Primary Examiner* — Phuong Chi Thi Nguyen
(74) *Attorney, Agent, or Firm* — Venjuris, P.C.

(57) ABSTRACT

A terminal module disclosed by this specification is provided with a shielded cable including two coated wires, a conductive shield portion for covering outer peripheries of the two coated wires and a sheath portion for covering an outer periphery of the shield portion, inner conductors to be connected to the coated wires, an insulating terminal accommodating member for accommodating end parts of the coated wires together with the inner conductors, and an outer conductor for accommodating the terminal accommodating member. An axis center β of a shield-side pull-out portion for pulling out the coated wires in the shield portion is radially shifted with respect to axis centers α of inner conductor-side pull-out portions for pulling out the coated wires in the inner conductors. A wire insertion path into
(Continued)

which linking portions are insertable is formed in a lower wall of the terminal accommodating member.

4 Claims, 23 Drawing Sheets

(51) Int. Cl.
*H01R 13/6591* (2011.01)
*H01R 9/03* (2006.01)
*H01R 13/40* (2006.01)

(56) References Cited

U.S. PATENT DOCUMENTS 6,203,377 B1 * 3/2001 Grek ..... H01R 13/65912
439/607.44
6,257,931 B1 * 7/2001 Sakurai ..... H01R 9/0518
439/394
6,702,611 B1 * 3/2004 Miyazaki ..... H01R 13/6593
439/564
6,830,480 B2 * 12/2004 Yoshioka ..... H01R 13/6477
439/607.42
7,377,811 B2 * 5/2008 Anderson ..... H01R 4/726
439/607.41
2019/0319406 A1 10/2019 Maesoba et al.

* cited by examiner

TERMINAL MODULE, AND CONNECTOR

CROSS REFERENCE TO RELATED APPLICATIONS

This application is a national phase of PCT application No. PCT/JP2019/050101, filed on 20 Dec. 2019, which claims priority from Japanese patent application No. 2018-247605, filed on 28 Dec. 2018, all of which are incorporated herein by reference.

TECHNICAL FIELD

A technique disclosed by this specification relates to a terminal module and a connector.

BACKGROUND

A high-frequency connector to be connected to an end of a shielded cable in which the outer periphery of a coated wire having a core covered by an insulating inner sheath is covered by a braided wire and an insulating outer sheath is, for example, known from Japanese Patent Laid-Open Publication No. 2011-253724 (Patent Document 1 below). This high-frequency connector includes an inner conductor terminal to be connected to the core exposed by stripping the shielded cable, an insulating dielectric for accommodating the inner conductor terminal in a cavity provided inside, an outer conductor terminal for covering the dielectric from outside and a connector housing for accommodating the outer conductor terminal. In the shielded cable, the braided wire exposed by stripping the insulating outer sheath is electrically connected to the inner peripheral surface of the outer conductor terminal and the core of the coated wire pulled out straight forward from the braided wire and the insulating outer sheath is introduced into the inner conductor terminal and electrically connected to the inner conductor terminal.

PRIOR ART DOCUMENT

Patent Document

Patent Document 1: JP 2011-253724 A

SUMMARY OF THE INVENTION

Problems to be Solved

In the connector of this type, depending on the structure of the outer conductor terminal, an axis center of the coated wire pulled out from the inner conductor terminal and that of the coated wire pulled out from the braided wire and the insulating outer sheath cannot be coaxially arranged and may be misaligned. If the axis center of the coated wire pulled out from the inner conductor terminal and that of the coated wire pulled out from the braided wire and the insulating outer sheath are misaligned, the coated wire pulled from the dielectric accommodating the inner conductor terminal may be drastically bent. If the coated wire is drastically bent, there is a concern that communication quality is reduced due to the reflection of a signal. Further, since the coated wire needs to be assembled with the inner conductor terminal and the outer conductor terminal while being drastically bent, assembling workability is deteriorated.

A technique for suppressing the deterioration of assembling workability and suppressing a reduction in communication quality is disclosed in this specification.

Means to Solve the Problem

The technique disclosed by this specification is directed to a terminal module with a shielded cable including at least one coated wire, a conductive shield portion for covering an outer periphery of the coated wire and a sheath portion for covering an outer periphery of the shield portion, an inner conductor to be connected to the coated wire, an insulating terminal accommodating member for accommodating an end part of the coated wire together with the inner conductor, and an outer conductor to be fixed while being electrically connected to the shield portion as the terminal accommodating member is accommodated into the outer conductor, wherein an axis center of a shield-side pull-out portion for pulling out the coated wire in the shield portion is radially shifted with respect to an axis center of an inner conductor-side pull-out portion for pulling out the coated wire in the inner conductor, and a wire insertion path is formed in a part of a wall portion of the terminal accommodating member on a side toward which the axis center of the shield-side pull-out portion is shifted and a linking portion of the coated wire located between the inner conductor-side pull-out portion and the shield-side pull-out portion is insertable into the wire insertion path.

Further, the technique disclosed by this specification is directed to a connector with the above terminal module and a housing for accommodating the terminal module.

If, for example, the wire insertion path is not formed in the terminal accommodating member, the linking portion of the coated wire pulled out from the inner conductor-side pull-out portion is disposed along an inner wall surface of the terminal accommodating member and is drastically bent toward the shield-side pull-out portion after being pulled out from the terminal accommodating member. A signal is easily reflected due to drastic bending and the coated wire may be damaged due to a bending stress in the linking portion of the coated wire.

However, according to the cable with terminal configured as described above, the linking portion of the coated wire can be moderately inclined without being drastically bent by inserting the linking portion into the wire insertion path of the terminal accommodating member. In this way, a bending stress on the linking portion of the coated wire can be suppressed and a reduction in communication quality caused by the reflection of a signal due to the bending of the coated wire can be suppressed. Further, since the linking portion of the coated wire can be routed while being moderately inclined, the deterioration of assembling workability can be suppressed as compared to the case where the coated wire is assembled with the inner conductor and the outer conductor while being drastically bent.

The terminal module disclosed by this specification may be configured as follows.

A covering member for covering an outer periphery of the linking portion may be mounted on the linking portion of the coated wire, and the linking portion covered by the covering member may be insertable into the wire insertion path.

According to this configuration, the linking portion is made difficult to bend by mounting the covering member on the linking portion.

According to this configuration, since the linking portion covered by the covering member is insertable into the wire insertion path, a bending stress on the linking portion can be suppressed and a reduction in communication quality caused by the reflection of a signal due to the bending of the coated wire can be suppressed by inserting the linking portion into the wire insertion path.

The terminal accommodating member may include a first member having a first wall portion, the inner conductor and an end part of the coated wire being placed on the first wall portion, and a second member having a second wall portion for covering the inner conductor and the end part of the coated wire from a side opposite to the first wall portion of the first member, and the wire insertion path may be formed by setting either one of the first and second wall portions to be shorter in an extending direction of the coated wire than the other.

For example, if either one of the first wall portion of the first member and the second wall portion of the second member is cut to form a wire insertion path, the rigidity of the wall portion formed with the wire insertion path is reduced. Thus, there is a concern that the member formed with the wire insertion path is damaged due to contact with another member when the first and second members are assembled with the inner conductor and the coated wire.

However, according to this configuration, since the wire insertion path is formed by setting either one of the first wall portion of the first member and the second wall portion of the second member to be shorter than the other, the wire insertion path can be formed while a reduction in the rigidity of the first and second members is suppressed.

Effect of the Invention

According to the technique disclosed by this specification, it is possible to suppress the deterioration of assembling workability and suppress a reduction in communication quality.

DETAILED DESCRIPTION TO EXECUTE THE INVENTION

Embodiment

Figure 1:
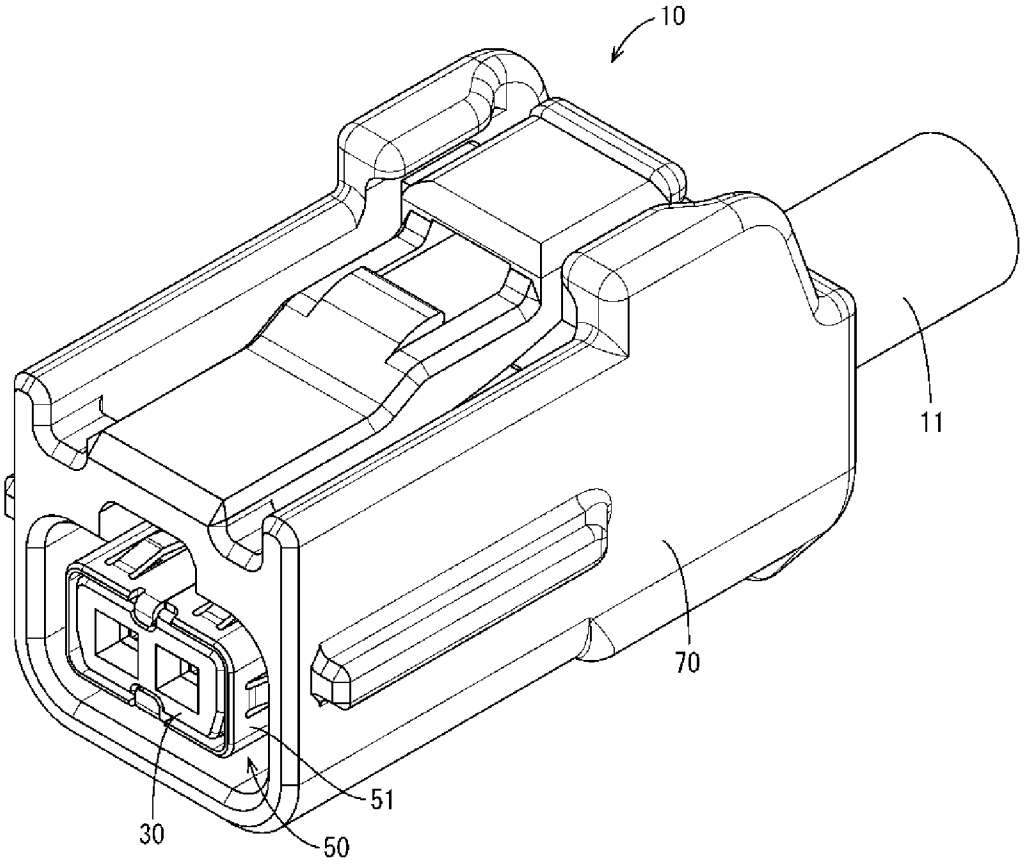
FIG. 1 is a perspective view of a connector according to an embodiment.
Figure 2:
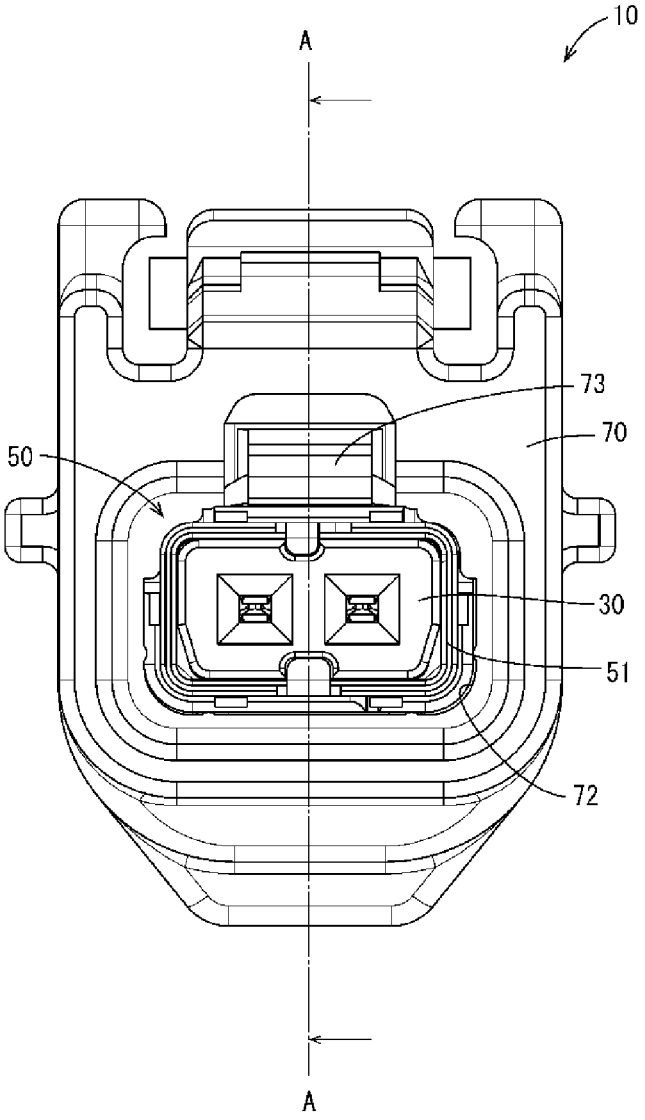
FIG. 2 is a front view of the connector.

One embodiment of the technique disclosed in this specification is described with reference to FIGS. 1 to 22.

A connector 10 for communication to be installed in a vehicle such an electric vehicle or hybrid vehicle and disposed in a wired communication path, for example, between an in-vehicle electrical component (car navigation system, ETC, monitor or the like) in the vehicle and an external device (camera or the like) or between in-vehicle electrical components is illustrated in this embodiment.

As shown in FIGS. 1 to 4, the connector 10 includes a shielded cable 11, a plurality of inner conductors 20 to be connected to a front end of the shielded cable 11, a terminal accommodating member 30 for accommodating the plurality of inner conductors 20, an outer conductor 50 to be connected to the shielded cable 11 while covering the outer periphery of the terminal accommodating member 30, and a housing 70 for accommodating the outer conductor 50.

The shielded cable 11 includes a plurality of coated wires 12, a shield portion 15 constituted by a braided wire for collectively covering the outer peripheries of the plurality of coated wires 12, and a sheath portion 16 constituted by an insulation coating for covering the outer periphery of the shield portion 15. In the shielded cable 11 of this embodiment, two coated wires 12 are collectively covered by the shield portion 15.

Each coated wire 12 is formed such that a conductive core 13 is covered by an insulating insulation coating 14. The two coated wires 12 are twisted in a state covered by the shield portion 15, and the sheath portion 16 is stripped in a front end part of the shielded cable 11 to expose the untwisted two coated wires 12 and the shield portion 15.

The shield portion 15 is formed by braiding a plurality of conductive metal thin wires into a tube. The shield portion 15 exposed from an end of the sheath portion 16 is folded on an end part of the sheath portion 16 to cover the outer periphery of the end part of the sheath portion 16, and this folded part of the shield portion 15 serves as a folded portion 15A. As shown in FIGS. 3 and 15 to 18, the two coated wires 12 are pulled out forward from the folded portion 15A and a part of the folded portion 15A where the coated wires 12 are pulled out serve as a shield-side pull-out portion 19.

A front end part of each coated wire 12 pulled out forward from the folded portion 15A has the insulation coating 14 further stripped to expose the core 13, and the inner conductor 20 is electrically connected to the exposed core 13.

The inner conductor 20 is formed by working a conductive metal plate material by a press or the like. The inner conductor 20 includes a connecting tube portion 22 in the form of a rectangular tube into which an unillustrated pin-like male terminal is inserted for connection, and a wire connecting portion 24 to be crimped and connected to ends of the core 13 and the insulation coating 14 is formed behind and continuously with the connecting tube portion 22. Further, a part crimped to the insulation coating 14 in a rear end part of the wire connecting portion 24 serves as an inner conductor-side pull-out portion 25 from which the coated wire 12 is pulled out rearward.

A part of the coated wire 12 disposed between the inner conductor-side pull-out portion 25 and the shield-side pull-out portion 19 serves as a linking portion 17, and an adjusting member 80 for adjusting an impedance in the linking portion 17 is mounted on the linking portion 17.

The adjusting member 80 is formed by working a conductive metal plate material by a press or the like. The adjusting member 80 includes two adjusting bodies 82 to be respectively mounted on the outer peripheries of the linking portions 17 in the coated wires 12 and a coupling portion 85 coupling the two adjusting bodies 82.

Each adjusting body 82 is formed into a substantially hollow cylindrical shape for covering the outer peripheral surface of the linking portion 17 in a circumferential direction. The adjusting body 82 is mounted in a substantially central part of the linking portion 17 in a front-rear direction, and a length in the front-rear direction of the adjusting body 82 is somewhat shorter than that of the linking portion 17.

Figure 16:
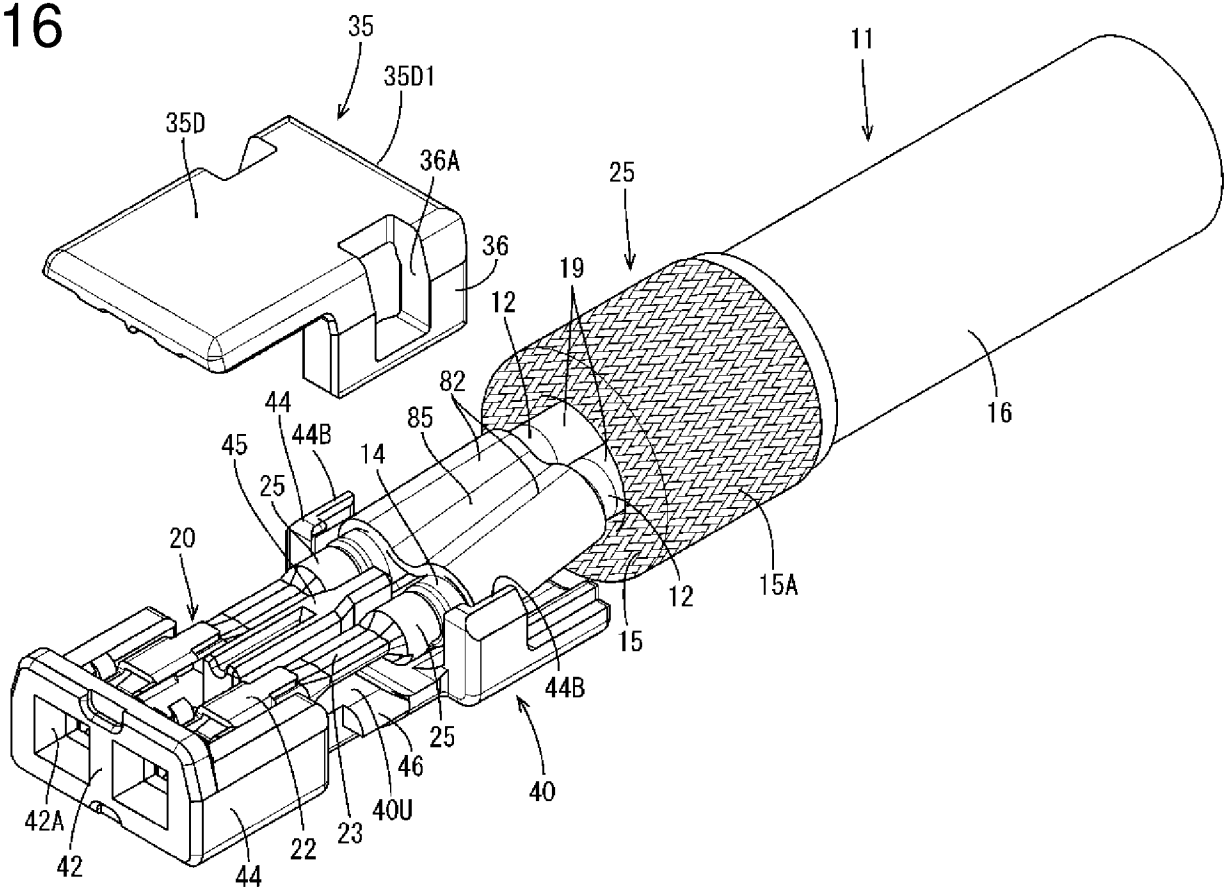
FIG. 16 is a perspective view showing a state before the lower member is assembled with the vertically inverted upper member having inner conductors mounted therein.
Figure 17:
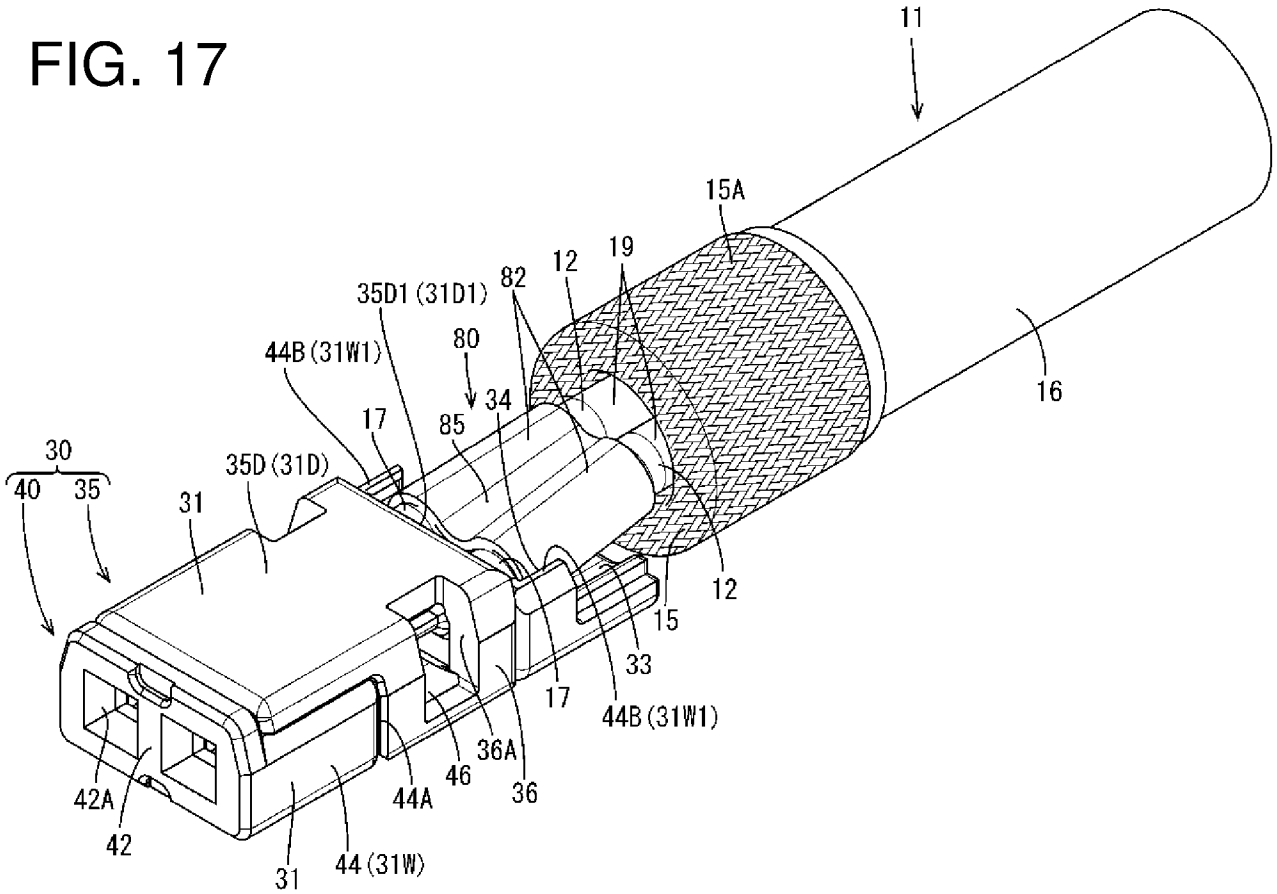
FIG. 17 is a perspective view showing a state where the inner conductors and end parts of coated wires are accommodated in a terminal accommodating member.
Figure 18:
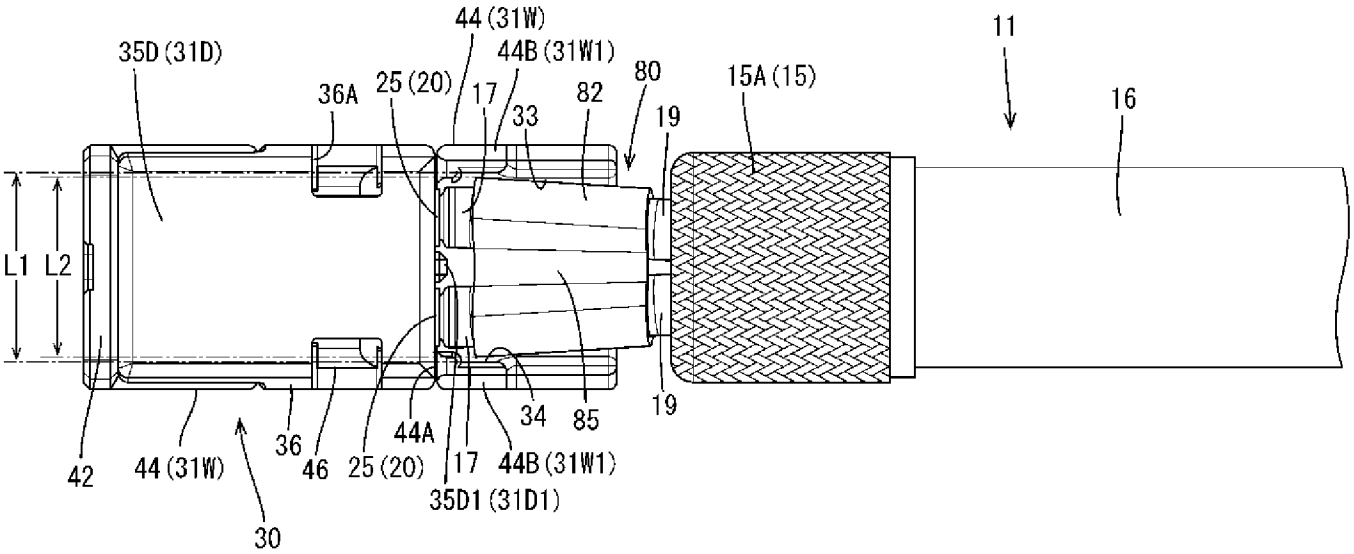
FIG. 18 is a plan view showing the state where the inner conductors and the end parts of the coated wires are accommodated in the terminal accommodating member.

The coupling portion 85 is curved to bulge upward and couples the two adjusting bodies 82 in a lateral direction. Further, as shown in FIGS. 16 to 18, the coupling portion 85 is formed to be laterally wider in a front part than in a rear part. Thus, the adjusting member 80 is laterally wider in a front part than in a rear part.

The terminal accommodating member 30 is made of synthetic resin and, as shown in FIGS. 4 to 11, in the form of a rectangular parallelepiped long in the front-rear direction.

Figure 3:
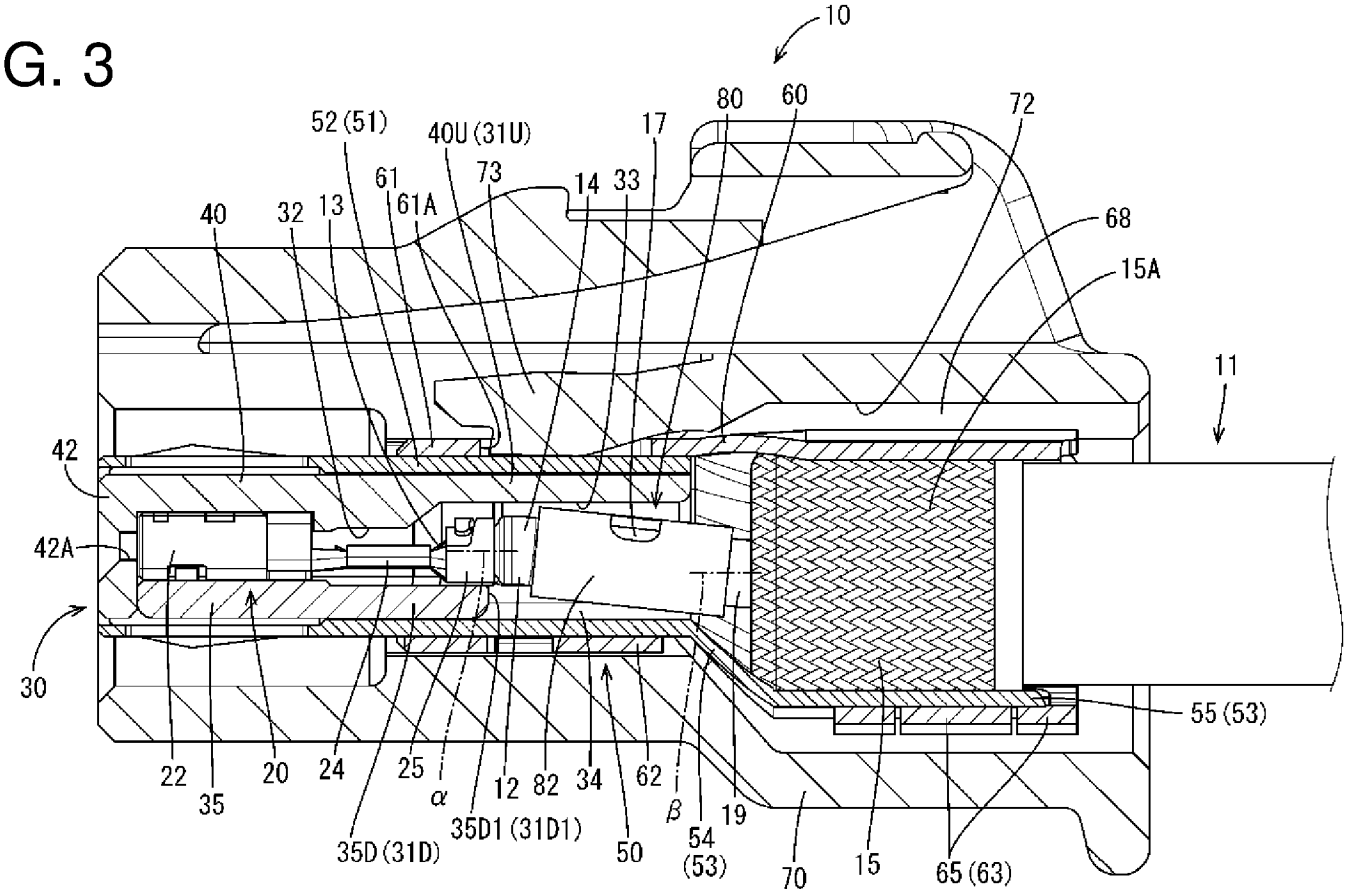
FIG. 3 is a section along A-A of FIG. 2.
Figure 22:
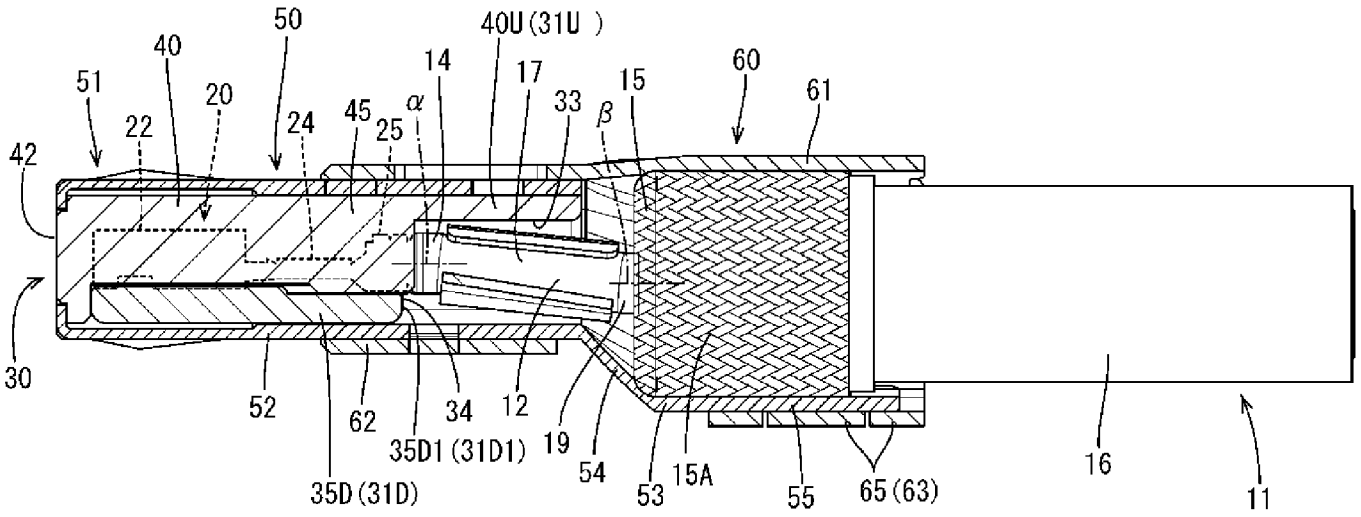
FIG. 22 is a section along D-D of FIG. 20.

Cavities 32 extending in the front-rear direction are formed side by side in the lateral direction on a side of the terminal accommodating member 30 forward of a central part in the front-rear direction. As shown in FIGS. 3 and 22, the inner conductors 20 connected to the coated wires 12 can be accommodated into the respective cavities 32.

A rear part of the terminal accommodating member 30 serves as a large accommodating portion 33 for accommodating the linking portions 17 pulled out rearward from the inner conductor-side pull-out portions 25 of the two inner conductors 20 together with the adjusting member 80.

Further, as shown in FIGS. 4 to 8, the terminal accommodating member 30 is configured by assembling a lower member 35 to be arranged in a lower part and an upper member 40 to be arranged in an upper part in a vertical direction.

As shown in FIGS. 4 to 8 and 11, the lower member 35 includes a bottom wall 35D constituting a lower wall 31D of a wall portion 31 of the terminal accommodating member 30 and a pair of locking pieces 36 provided on both side edges of the bottom wall 35D. The bottom wall 35D is in the form of a substantially rectangular plate long in the front-rear direction, and the two inner conductors 20 are placed side by side in the lateral direction on the bottom wall 35D.

The pair of locking pieces 36 are formed to extend upward from a rear end part of the bottom wall 35D, and each locking piece 36 includes a substantially rectangular locking hole 36A penetrating in the lateral direction.

As shown in FIGS. 4 to 10, the upper member 40 includes a ceiling wall 40U constituting an upper wall 31U of the terminal accommodating member 30, a front wall 42 provided on a front end part of the ceiling wall 40U and side walls 44 respectively provided on both lateral side edges of the ceiling wall 40U.

The ceiling wall 40U is in the form of a substantially rectangular flat plate long in the front-rear direction, and dimensioned to cover the inner conductors 20 and the end parts of the coated wires 12 from a side opposite to the bottom wall 35D of the lower member 35. A separation wall 45 extending downward from the ceiling wall 40U is formed in a substantially central part in the lateral direction of the ceiling wall 40U. The separation wall 45 is disposed to be proximate to and vertically face the bottom wall 35D of the lower member 35 and two cavities 32 for accommodating the inner conductors 20 are configured in the terminal accommodating member 30 when the upper member 40 and the lower member 35 are assembled.

The front wall 42 is in the form of a plate extending downward from the front end edge of the ceiling wall 40U and provided with insertion openings 42A into which the male terminals are inserted.

The pair of side walls 44 respectively extend downward from the ceiling wall 40U and are connected to both lateral side edges of the front wall 42.

A fitting recess 44 into which the locking piece 36 of the lower member 35 is fit when the upper member 40 and the lower member 35 are assembled is formed in a substantially central part in the front-rear direction of each side wall 44. The fitting recess 44A is cut in the vertical direction from a lower end part of the side wall 44 to the ceiling wall 40U, and a locking projection 46 projecting outward is formed on a side edge of the ceiling wall 40U facing the fitting recess 44A.

The locking projections 46 are fit into the locking holes 36A of the locking pieces 36 to hold the upper member 40 and the lower member 35 in an assembled state as shown in FIGS. 17 and 18 when the upper member 40 and the lower member 35 are assembled and the locking pieces 36 of the lower member 35 are fit into the fitting recesses 44A.

Figure 20:
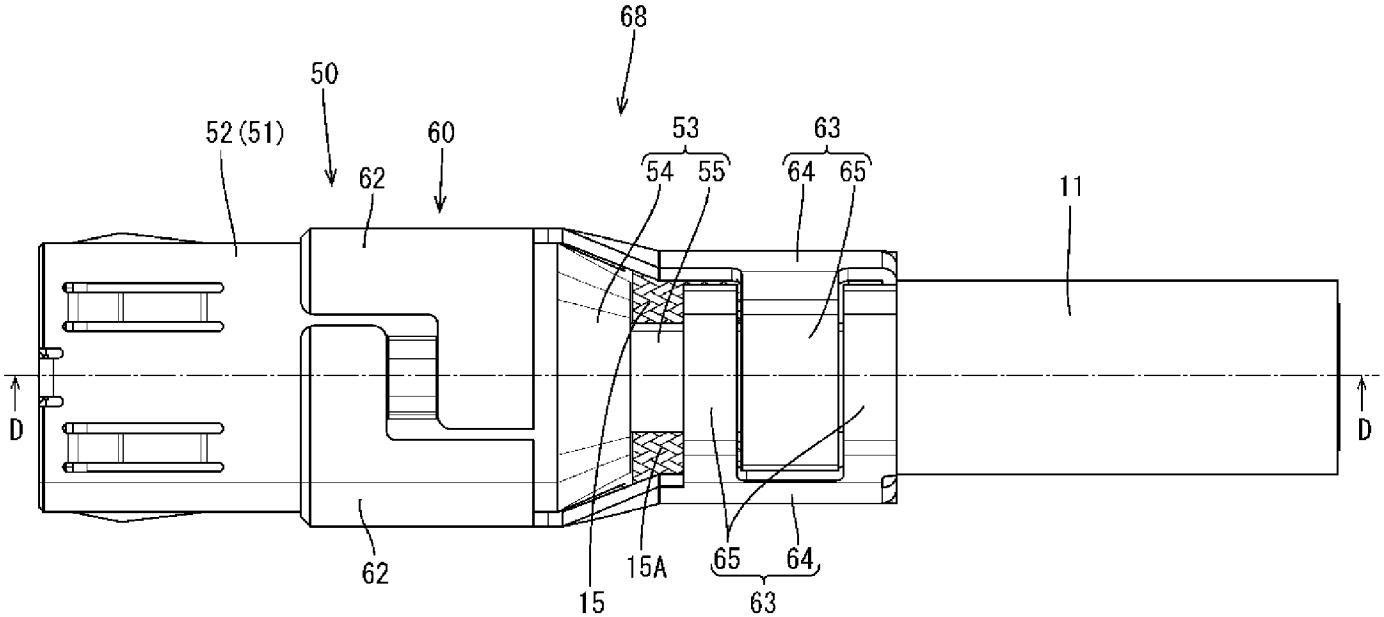
FIG. 20 is a plan view of a terminal module.
Figure 21:
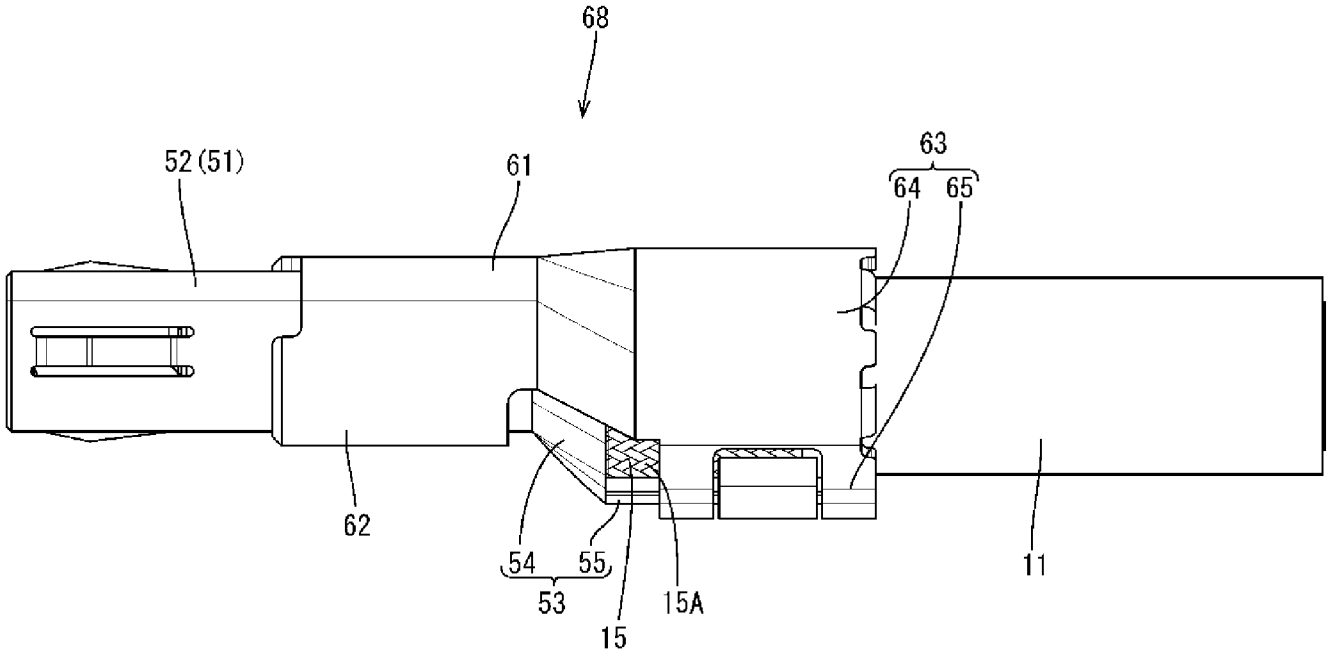
FIG. 21 is a side view of the terminal module.

As shown in FIGS. 20 to 22, the outer conductor 50 is composed of a first outer conductor 51 for covering the outer periphery of the terminal accommodating member 30 and a second outer conductor 60 to be assembled with the first outer conductor 51 to cover the outer peripheries of the first outer conductor 51 and the folded portion 15A of the shielded cable 11.

The first outer conductor 51 is formed by working a conductive metal plate material by a press or the like. As shown in FIGS. 3 and 22, the first outer conductor 51 includes a tubular portion 52 for accommodating the terminal accommodating member 30 and a shield connecting portion 53 provided on the rear end edge of the tubular portion 52.

Figure 12:
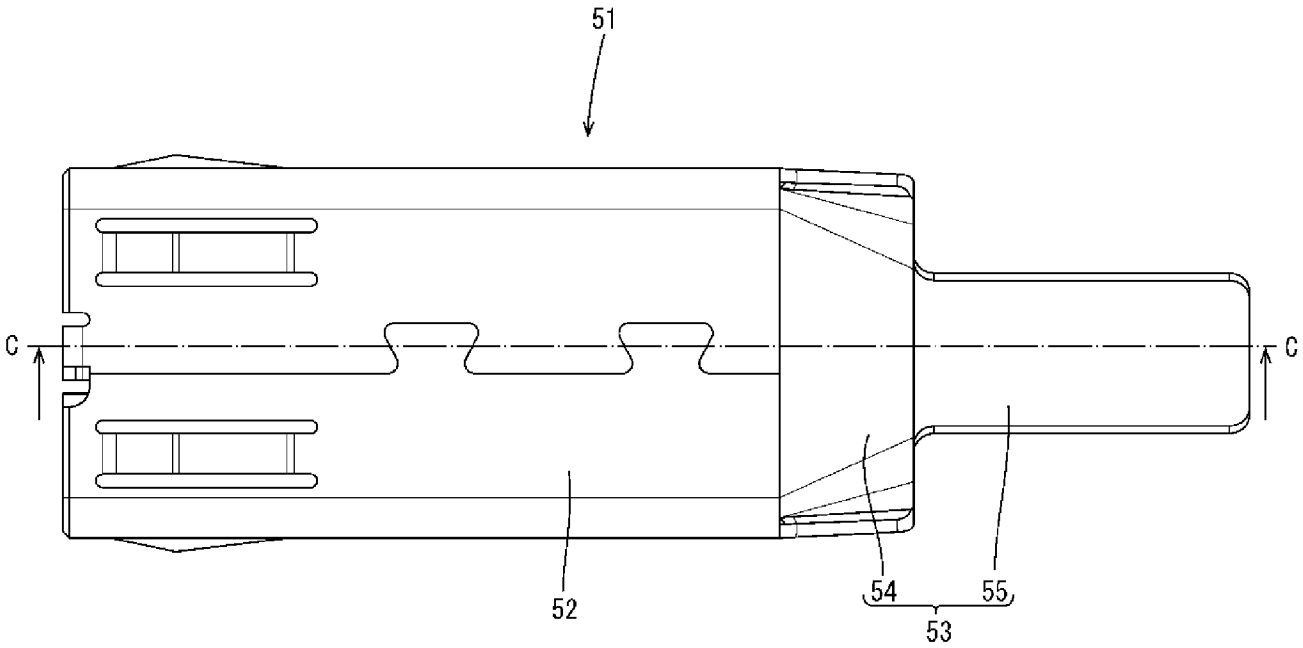
FIG. 12 is a plan view of a first outer conductor.
Figure 13:
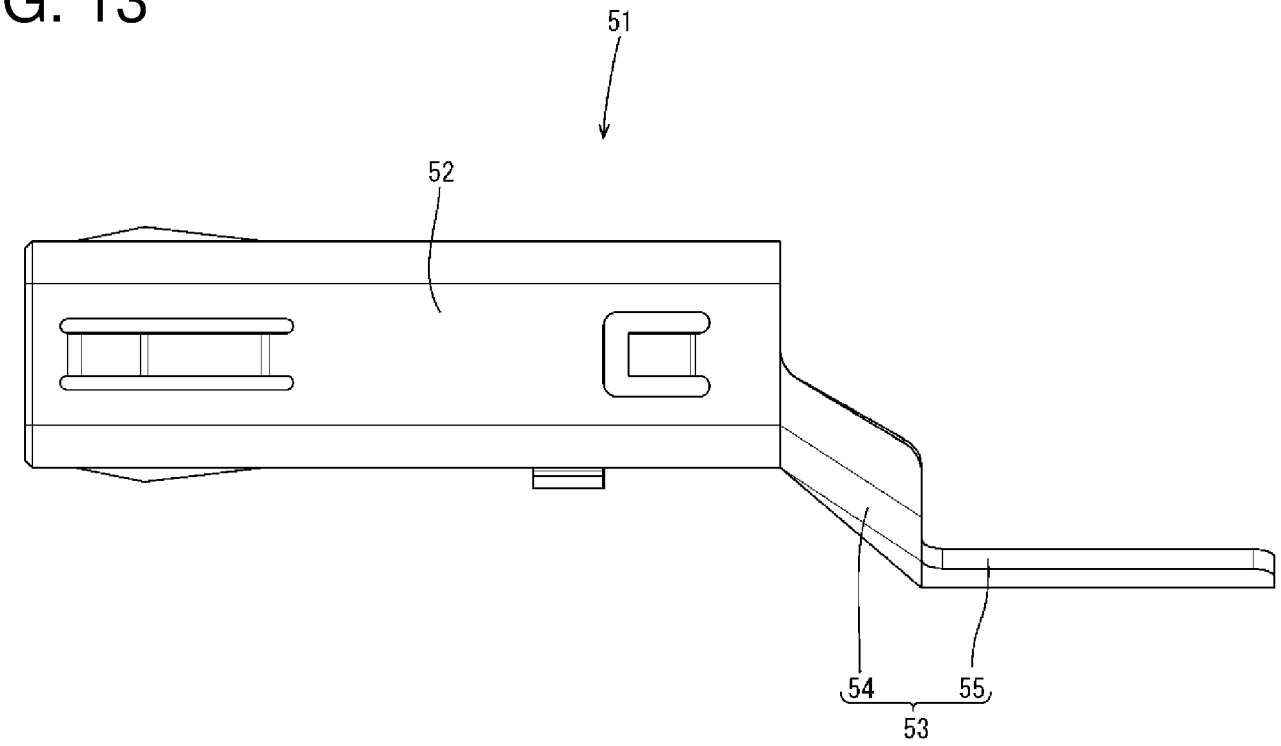
FIG. 13 is a side view of the first outer conductor.
Figure 14:
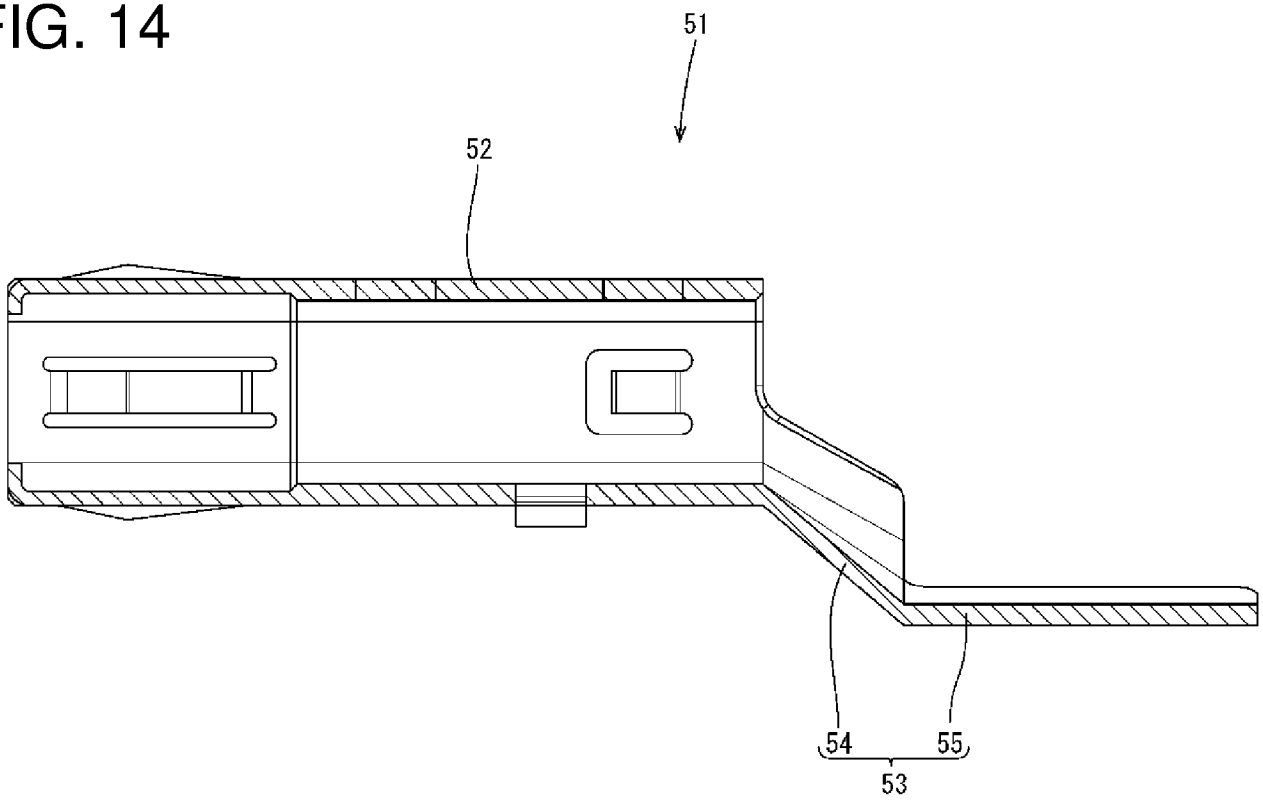
FIG. 14 is a section along C-C of FIG. 12.

As shown in FIGS. 12 to 14, the tubular portion 52 is in the form of a rectangular tube having a substantially rectangular front view shape, and the terminal accommodating member 30 is inserted and accommodated into the tubular portion 52 from behind.

The shield connecting portion 53 includes a linking piece 54 obliquely extending to a lower-rear side from the rear end edge of a lower side of the tubular portion 52 and a tongue piece 55 extending straight rearward from the rear end edge of the linking piece 54.

The tongue piece 55 is in the form of a substantially rectangular plate. When the terminal accommodating member 30 is accommodated into the tubular portion 52, the tongue piece 55 is arranged below the folded portion 15A in the shielded cable 11 as shown in FIGS. 3 and 22.

The second outer conductor 60 is formed by working a conductive metal plate material by a press or the like. As shown in FIGS. 19 to 22, the second outer conductor 60 includes a ceiling plate 61 extending from the tubular portion 52 to the position of the folded portion 15A of the shielded cable 11, a pair of fixing barrels 62 provided on a front part of the ceiling plate 61 and a pair of connection barrels 63 provided on a rear part of the ceiling plate 61.

The ceiling plate 61 is dimensioned to cover a region from a rear part of the tubular portion 52 to the folded portion 15A from above, and a lance hole 61A penetrating in the vertical direction is provided in the front part of the ceiling plate 61.

The pair of fixing barrels 62 are provided on both lateral side edge edges in the front part of the ceiling plate 61, and so crimped to the rear part of the tubular portion 52 as to wind around the tubular portion 52 from both lateral sides.

The pair of connection barrels 63 are so provided on the both lateral side edges in the rear part of the ceiling plate 61 as to be connected behind the pair of fixing barrels 62.

One of the pair of connection barrels 63 includes a side plate 64 to be arranged along one lateral side part of the folded portion 15A and a fixing piece 65 provided on the upper end of the shield portion 64, and the other includes a shield portion 64 to be arranged along the other lateral side part in the folded portion 15A and two fixing pieces 65 provided on the upper end of the shield portion 64.

As shown in FIGS. 3 and 22, the respective fixing pieces 65 are crimped and fixed to wind around the tongue piece 55 of the first outer conductor 51 arranged below the folded portion 15A and a lower part of the folded portion 15A.

Further, if the respective fixing pieces 65 are crimped and fixed to the folded portion 15A and the tongue piece 55, the folded portion 15A is pulled toward the tongue piece 55 arranged therebelow and the tongue piece 55 extends along the lower outer peripheral surface of the folded portion 15A and an axis center β of the shield-side pull-out portion 19 is shifted radially downward with respect to axis centers α of the inner conductor-side pull-out portions 25 in the inner conductors 20 as shown in FIGS. 3 and 22.

Further, a tip part of each fixing piece 65 is folded inward to form a hook portion 66.

The hook portion 66 is hooked to either one of both lateral side edges of the tongue piece 55 to fix the fixing piece 65 so that the fixing piece 65 is not detached from the shield portion 15 when each fixing piece 65 is crimped. In this way, the outer conductor 50 composed of the first outer conductor 51 and the second outer conductor 60 is electrically connected and fixed to the shield portion 15 of the shielded cable 11.

The housing 70 is made of synthetic resin and includes a module accommodating portion 72 for accommodating a terminal module 68 formed by mounting the inner conductors 20, the terminal accommodating member 30 and the outer conductor 50 on the end of the shielded cable 11 as shown in FIG. 3.

The module accommodating portion 72 is in the form of a rectangular tube hollow in the front-rear direction, and a locking lance 73 lockable to an edge part of the lance hole 61A in the outer conductor 50 of the terminal module 68 is provided in the module accommodating portion 72. The locking lance 73 is fit into the lance hole 61A and the terminal module 68 is held in the housing 70 by the locking of the locking lance 73 and the edge part of the lance hole 61A as shown in FIG. 3 if the terminal module 68 is accommodated at a proper accommodation position of the module accommodating portion 72.

A wire insertion path 34 into which the linking portions 17 of the coated wires 12 are insertable is formed in the lower wall 31D (wall portion 31 on a lower side toward which the axis center β of the shield-side pull-out portion 19 is shifted with respect to the axis centers α of the inner conductor-side pull-out portions 25) of the wall portion 31 constituting the terminal accommodating member 30 as shown in FIGS. 3 and 22.

As shown in FIGS. 3, 17, 18 and 22, the wire insertion path 34 is constituted by a rear end edge part 31D1 of the lower wall 31D and upper end edge parts 31W1 in rear parts of the side walls 31W located on both lateral sides by setting the lower wall 31D to be shorter in the front-rear direction than the upper wall 31U in the rear part of the terminal accommodating member 30, and the large accommodating portion 33 is open downward due to the wire insertion path 34.

In other words, the bottom wall 35D of the lower member 35 is formed to be shorter in the front-rear direction than the ceiling wall 40U of the upper member 40. If the lower member 35 and the upper member 40 are assembled, the wire insertion path 34 is formed by the rear end edge part 35D1 in the bottom wall 35D of the lower member 35 and the lower end edge parts 44B in the side walls 44 on the both lateral sides of the upper member 40.

Further, a width L1 in the lateral direction of the wire insertion path 34 is set to be larger than a width L2 in the lateral direction of the adjusting member 80, so that the linking portions 17 having the adjusting member 80 mounted thereon can be inserted into the wire insertion path 34.

Accordingly, as shown in FIGS. 3 and 22, the linking portions 17 of the coated wires 12 obliquely extending while being moderately inclined toward the shield-side pull-out portion 19 located on an oblique lower-rear side from the inner conductor-side pull-out portions 25 are routed in the wire insertion path 34 with the adjusting member 80 mounted thereon.

This embodiment is configured as described above. Next, an example of an assembling procedure of the connector 10 for communication is briefly described and, then, functions and effects of the connector 10 are described.

Figure 15:
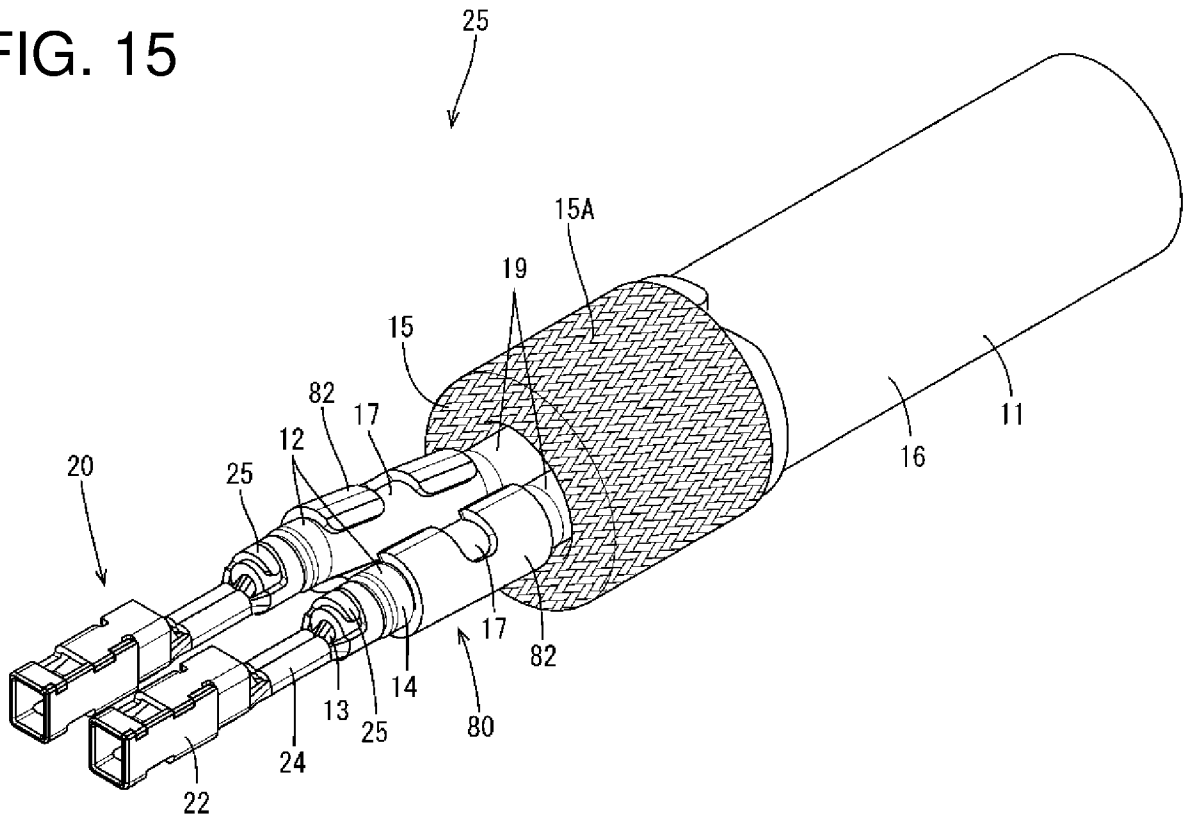
FIG. 15 is a perspective view showing a state where an adjusting member is mounted on linking portions.

First, the sheath portion 16 of the shielded cable 11 is stripped to expose the ends of the two coated wires 12 and the shield portion 15, and the shield portion 15 is folded on the outer surface of the sheath portion 16 to form the shield portion 15A. Further, the insulation coatings 14 of the front end parts of the two coated wires 12 are stripped to expose the cores 13 and, as shown in FIG. 15, the inner conductors 20 are connected by crimping the wire connecting portions 24 to the exposed cores 13.

Figure 4:
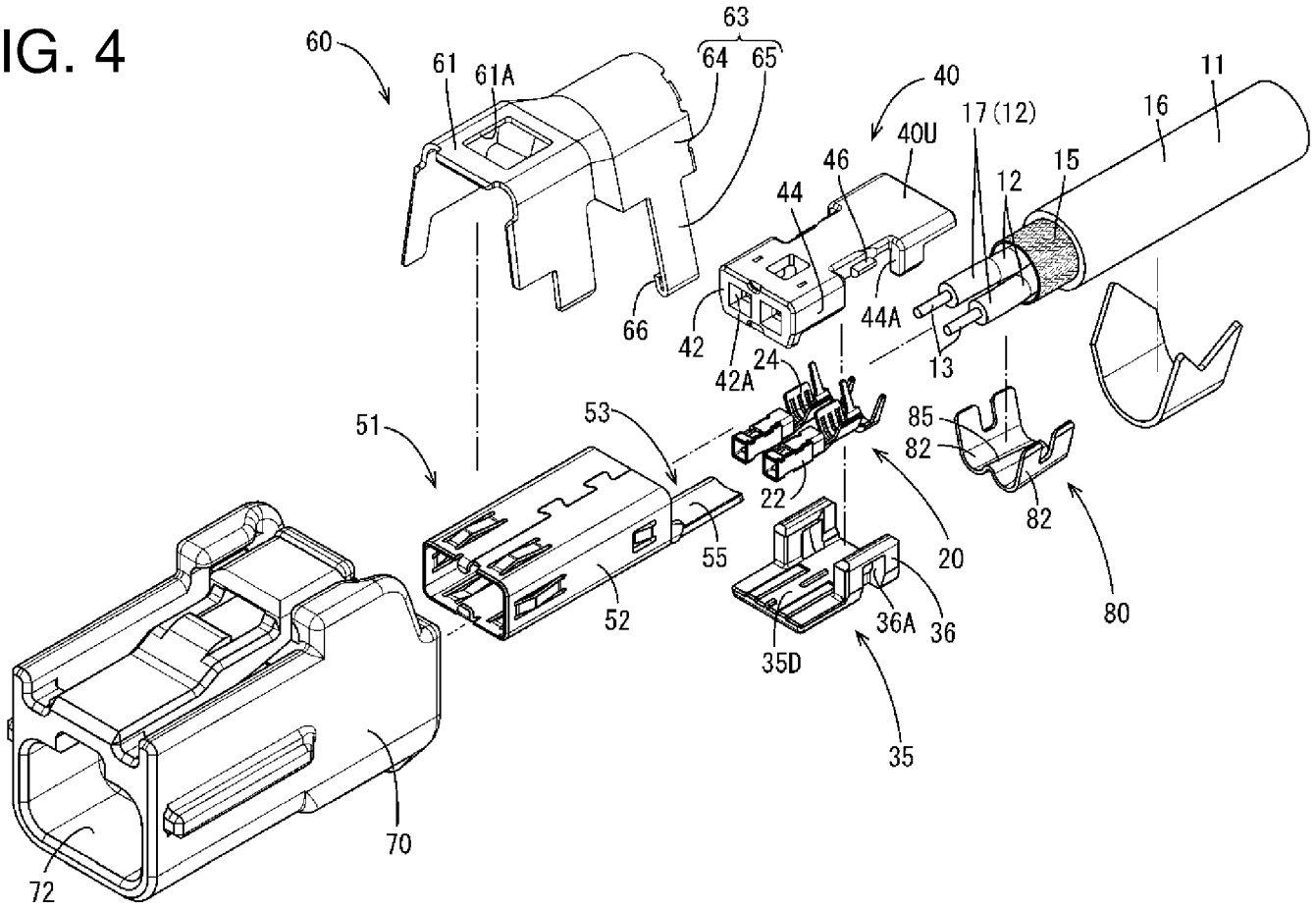
FIG. 4 is an exploded perspective view of the connector.
Figure 5:
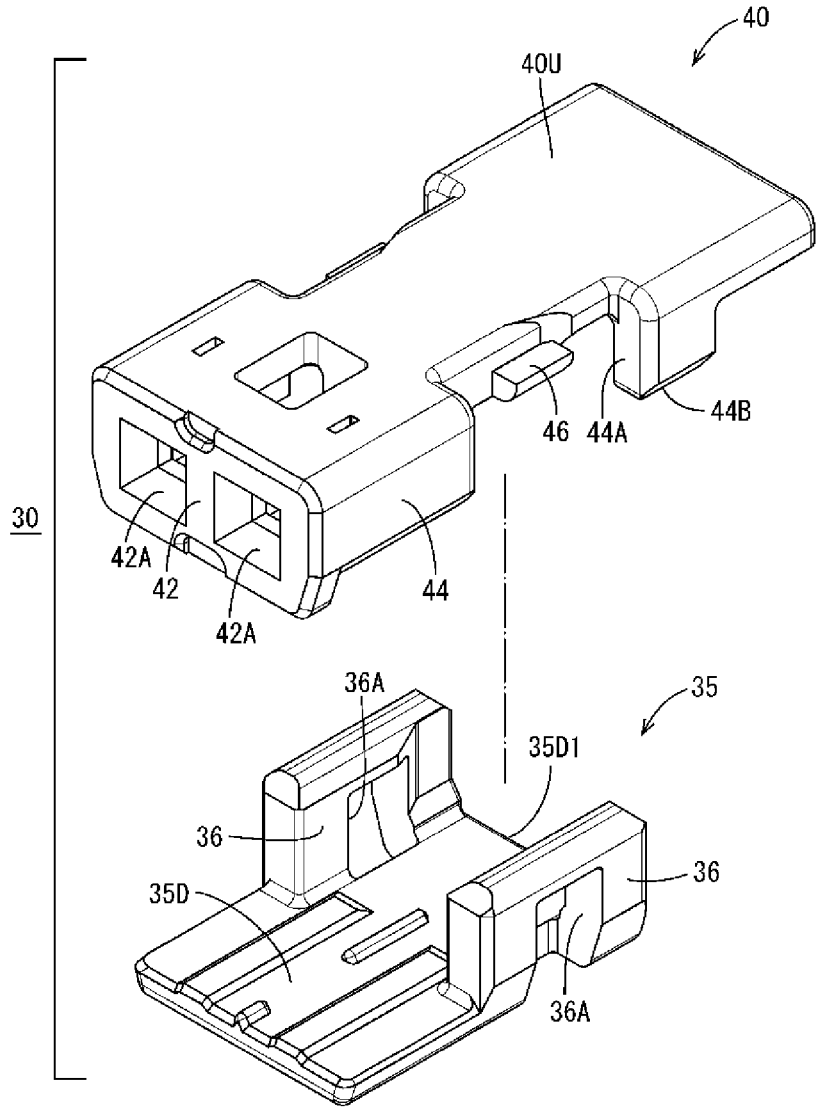
FIG. 5 is a perspective view showing a state before a lower member and an upper member are assembled.
Figure 6:
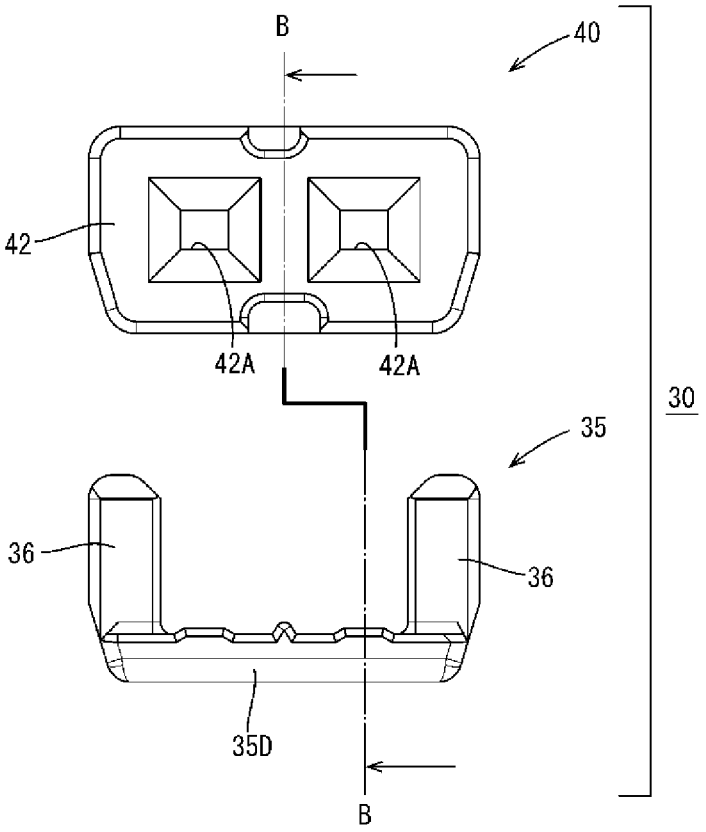
FIG. 6 is a front view showing the state before the lower member and the upper member are assembled.
Figure 7:
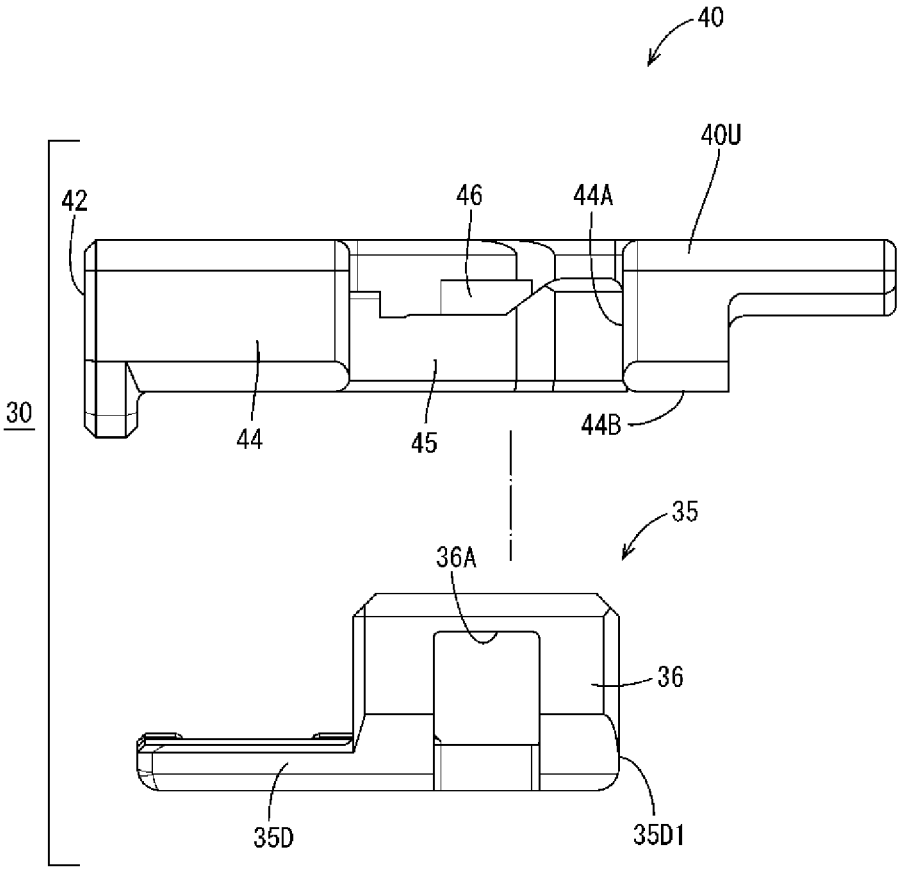
FIG. 7 is a side view showing the state before the lower member and the upper member are assembled.
Figure 8:
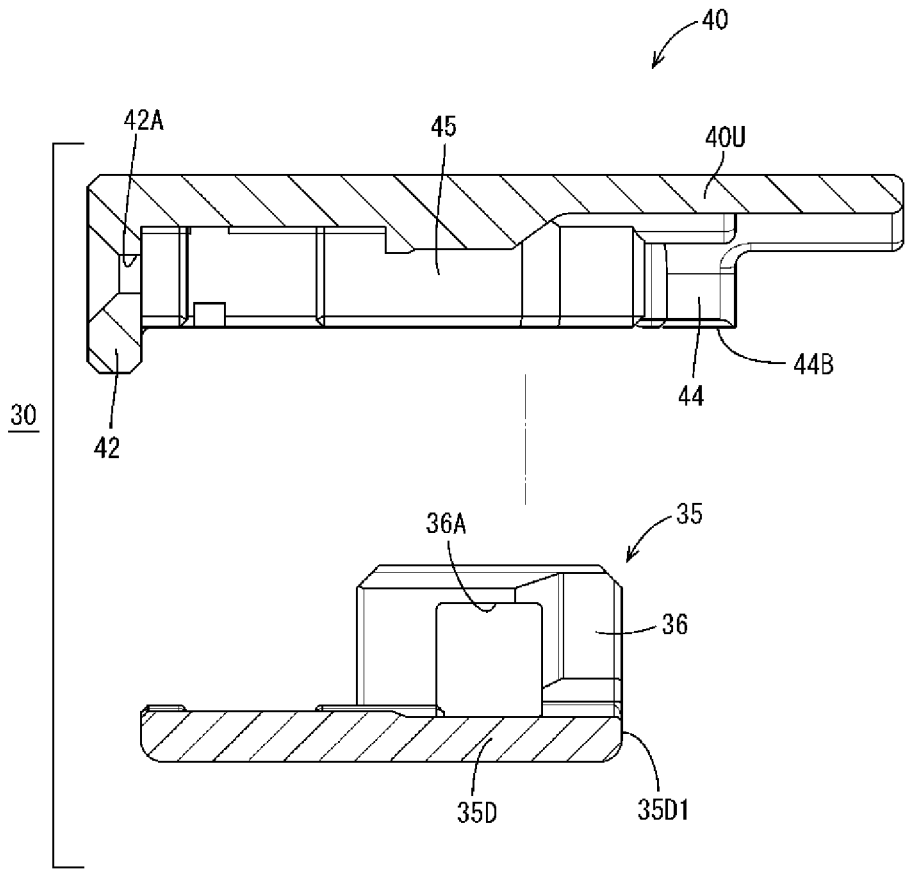
FIG. 8 is a section along B-B of FIG. 6.
Figure 9:
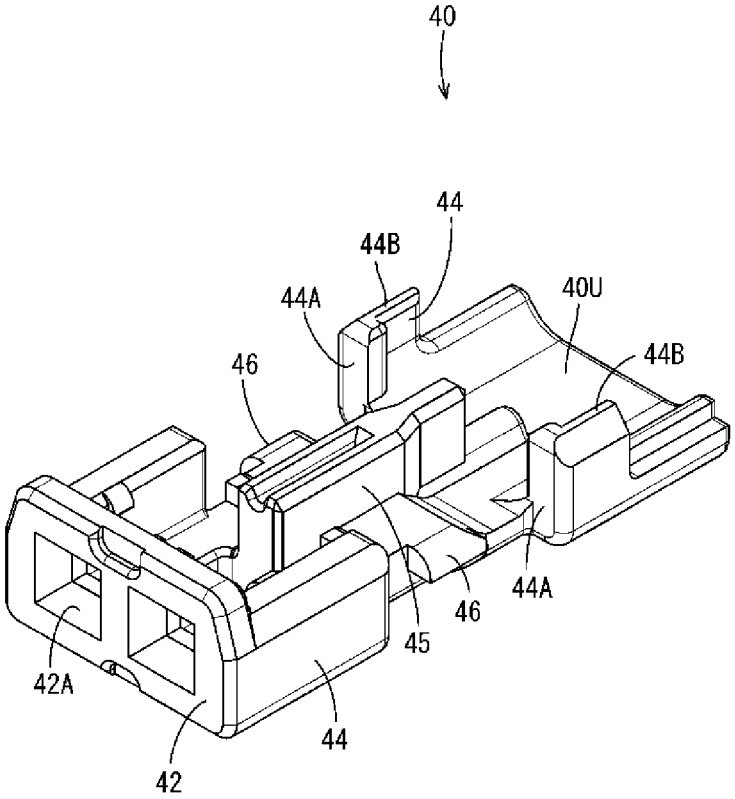
FIG. 9 is a perspective view of the vertically inverted upper member.
Figure 10:
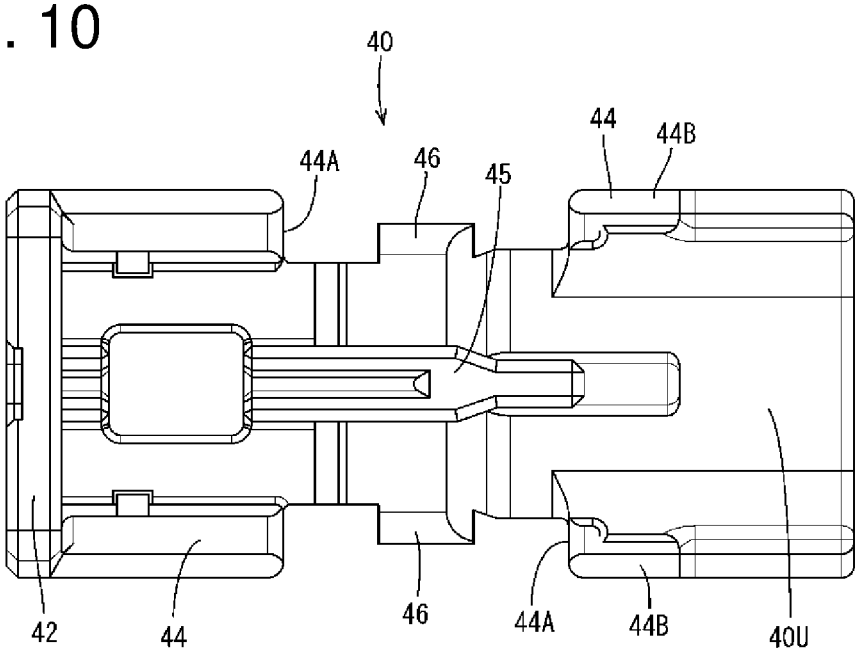
FIG. 10 is a bottom view of the upper member.
Figure 11:
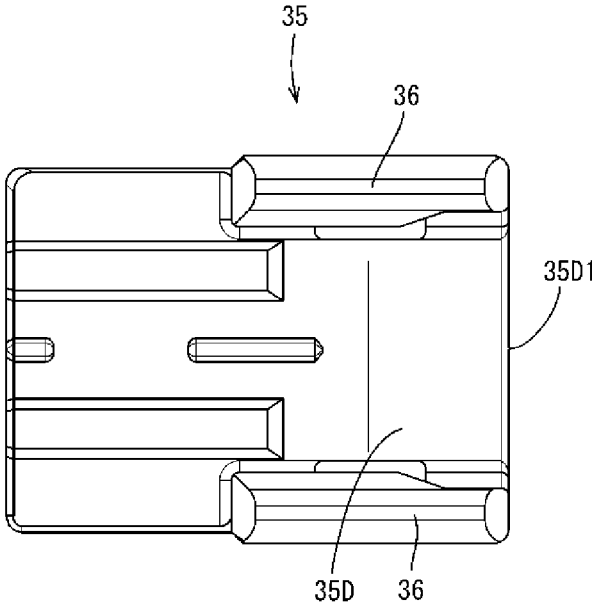
FIG. 11 is a plan view of the lower member.

Subsequently, the adjusting member 80 is mounted on the linking portions 17 of the two coated wires 12 of the shielded cable 11. In a disassembled state before being mounted on the linking portions 17, upper parts constituting the adjusting bodies 82 are open upward as shown in FIG. 4, the linking portions 17 of the coated wires 12 are arranged on the adjusting member 80 with the open adjusting bodies 82, and the adjusting bodies 82 are crimped to wind around the linking portions 17, whereby the adjusting member 80 is fixed to the linking portions 17.

Subsequently, as shown in FIG. 16, the two inner conductors 20 are mounted on the ceiling wall 40U of the vertically inverted upper member 40 and the lower member 35 is assembled with the upper member 40 from above. In this way, the inner conductors 20 are accommodated into the terminal accommodating member 30 as shown in FIGS. 17 and 18.

Here, if the lower member 35 is assembled with the upper member 40, the wire insertion path 34 is formed by the rear end edge part 35D1 in the bottom wall 35D of the lower member 35 and the lower end edge parts 44B in the side walls 44 on the both lateral sides of the upper member 40 since the bottom wall 35D of the lower member 35 is formed to be shorter in the front-rear direction than the ceiling wall 40U of the upper member 40. In this way, as shown in FIGS. 17 and 18, the large accommodating portion 33 of the terminal accommodating member 30 is open upward and the linking portions 17 having the adjusting member 80 mounted thereon are exposed through the wire insertion path 34.

Figure 19:
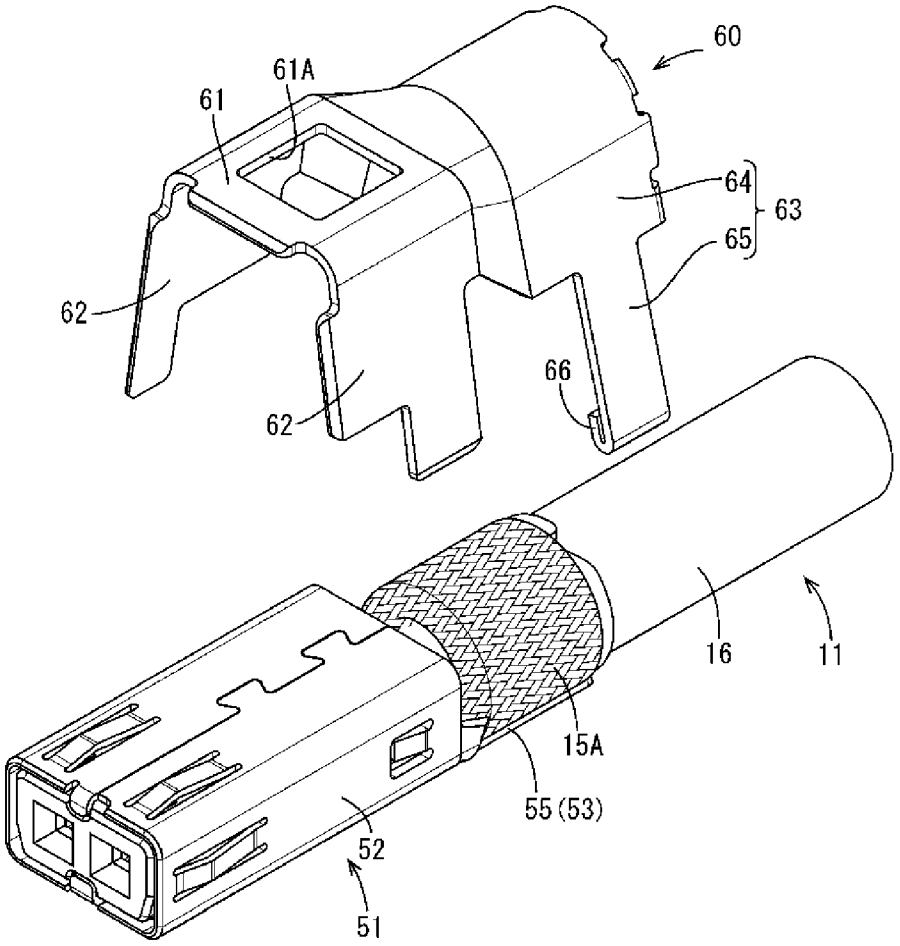
FIG. 19 is a perspective view showing a state before a second outer conductor terminal is assembled with the first outer conductor.

Subsequently, as shown in FIG. 19, the terminal accommodating member 30 is inserted into the tubular portion 52 in the first outer conductor 51 of the outer conductor 50 from behind and the second outer conductor 60 is assembled with the first outer conductor 51.

The second outer conductor 60 is assembled by mounting the ceiling plate 61 of the second outer conductor 60 on the first outer conductor 51 from above such that the tongue piece 55 of the first outer conductor 51 is on a lower side and crimping the fixing barrels 62 to wind around the tubular portion 52. Further, the respective fixing pieces 65 of the connection barrels 63 are crimped to wind around the tongue piece 55 and the shield portion 15.

If the respective fixing pieces 65 are crimped, the folded portion 15A is pulled toward the tongue piece 55 disposed on the lower side and, as shown in FIG. 22, the outer peripheral surface of the lower side of the folded portion 15A extends along the tongue piece 55 and the axis center β of the shield-side pull-out portion 19 is shifted radially downward with respect to the axis centers α of the inner conductor-side pull-out portions 25 in the inner conductors 20.

Then, the linking portions 17 of the coated wires 12 extending from the inner conductor-side pull-out portions 25 toward the shield-side pull-out portion 19 are inserted obliquely downward in a wire inserting portion while being moderately inclined.

Further, if the respective fixing pieces 65 are crimped, the hook portions 66 of the fixing pieces 65 are hooked to the side edges of the tongue piece 55 as shown in FIGS. 20 to 22, whereby the fixing pieces 65 are fixed not to be detached from the tongue piece 55 and the shield portion 15 and the terminal module 68 in which the inner conductors 20, the terminal accommodating member 30 and the outer conductor 50 are mounted on the end of the shielded cable 11 is completed.

Finally, the terminal module 68 is inserted into the mold accommodating portion 72 of the housing 70 from behind. If the terminal module 68 reaches the proper accommodation position, the locking lance 73 is fit into the lance hole 61A of the outer conductor 50 and the terminal module 68 is retained and held in the housing 70 as shown in FIG. 3. In this way, the connector 10 for communication is completed.

Next, functions and effects of the connector 10 for communication are described.

If the axis centers α of the inner conductor-side pull-out portions 25 of the inner conductors 20 and the axis center β of the shield-side pull-out portion 19 cannot be coaxially set and are radially misaligned as in this embodiment, there is a concern that the linking portions 17 of the coated wires 12 routed between the inner conductor-side pull-out portions 25 and the shield-side pull-out portion 19 are drastically bent and signals in the coated wires 12 are easily reflected due to the drastically bent linking portions 17. Further, the coated wires 12 may be damaged by bending stresses generated in the linking portions 17.

Accordingly, the present inventors diligently studied to solve the above problem and, as a result, found out the configuration of this embodiment. That is, in the connector 10 for communication of this embodiment, the terminal module 68 includes the shielded cable 11 having at least one coated wire 12, the conductive shield portion 15 for covering the outer peripheries of the coated wires 12 and the sheath portion 16 for covering the outer periphery of the shield portion 15, the inner conductors 20 to be connected to the coated wires 12, the insulating terminal accommodating member 30 for accommodating the inner conductors 20 and the end parts of the coated wires 12, and the outer conductor 50 to be fixed while being electrically connected to the shield portion 15 as the terminal accommodating member 30 is accommodated into the outer conductor 15, the axis center β of the shield-side pull-out portion 19 for pulling out the coated wires 12 in the shield portion 15 is radially shifted with respect to the axis centers α of the inner conductor-side pull-out portions 25 for pulling out the coated wires 12 in the inner conductors 20, and the wire insertion path 34 into which the linking portions 17 of the coated wires 12 between the inner conductor-side pull-out portions 25 and the shield-side pull-out portion 19 are insertable is formed in the wall portion (lower wall 31D) 31 on the lower side of the wall portion 31 of the terminal accommodating member 30 toward which the axis center β of the shield-side pull-out portion 19 is shifted.

That is, as shown in FIGS. 3 and 22, the linking portions 17 of the coated wires 12 can be routed while being moderately inclined without being drastically bent by inserting the linking portions 17 into the wire insertion path 34 of the terminal accommodating member 30. In this way, bending stresses on the linking portions 17 of the coated wires 12 can be suppressed and a reduction in communication quality caused by the reflection of signals due to the bending of the coated wires 12 can be suppressed. Further, since the linking portions 17 of the coated wires 12 can be routed while being moderately inclined, the deterioration of assembling workability can be suppressed, for example, as compared to the case where coated wires are assembled with inner conductors and an outer conductor with linking portions drastically bent.

Further, the adjusting member (covering member) 80 for covering the outer peripheries of the linking portions 17 is mounted on the linking portions 17 of the coated wires 12, and the wire insertion path 34 is dimensioned to have such a width L1 that the linking portions 17 covered by the adjusting member 80 are insertable into the wire insertion path 34.

In this embodiment, the linking portions 17 cannot be bent by mounting the adjusting member 80 on the linking portions 17. Since the wire insertion path 34 of this embodiment is formed such that the linking portions 17 covered by the adjusting member 80 are insertable thereinto, the linking portions 17 can be inserted into the wire insertion path 34, bending stresses on the linking portions 17 can be suppressed and a reduction in communication quality caused by the reflection of signals due to the bending of the coated wires 12 can be suppressed.

Further, as shown in FIGS. 4 to 8, the terminal accommodating member 30 includes the lower member (first member) 35 having the bottom wall 35D (first wall portion) on which the inner conductors 20 and the end parts of the coated wires 12 are placed, and the upper member (second member) 40 having the ceiling wall 40U (second wall portion) for covering the inner conductors 20 and the end parts of the coated wires 12 from the side opposite to the lower member 35, and the wire insertion path 34 is formed by setting either one of the bottom wall 35D and the ceiling wall 40U to be shorter in the front-rear direction, which is an extending direction of the coated wires 12, than the other.

For example, if either one of a bottom wall of a lower member and a ceiling wall of an upper member is cut to form a wire insertion path, the rigidity of the wall portion formed with the wire insertion path is reduced and the member formed with the wire insertion path may be broken, such as due to contact with another member when the lower member and the upper member are assembled with respect to an inner conductor and a coated wire.

However, according to this embodiment, since the wire insertion path 34 is formed by setting either one of the bottom wall 35D and the ceiling wall 40U to be shorter in the front-rear direction than the other, the wire insertion path 34 can be formed while a reduction in the rigidity of the lower member 35 and the upper member 40 is prevented.

Other Embodiments

The technique disclosed in this specification is not limited to the above described and illustrated embodiment and includes, for example, the following various modes.

(1) In the above embodiment, the adjusting member 80 is mounted on the linking portions 17. However, without limitation to this, no adjusting member may be mounted on linking portion(s) if impedance adjustment is not necessary.

(2) In the above embodiment, the wire insertion path 34 is formed by making the bottom wall 35D of the lower member 35 shorter in the front-rear direction than the ceiling wall 40U of the upper member 40. However, without limitation to this, the rigidity of a lower member and an upper member may be enhanced and a bottom wall of the lower member may be cut to form a wire insertion path.

Figure 23:
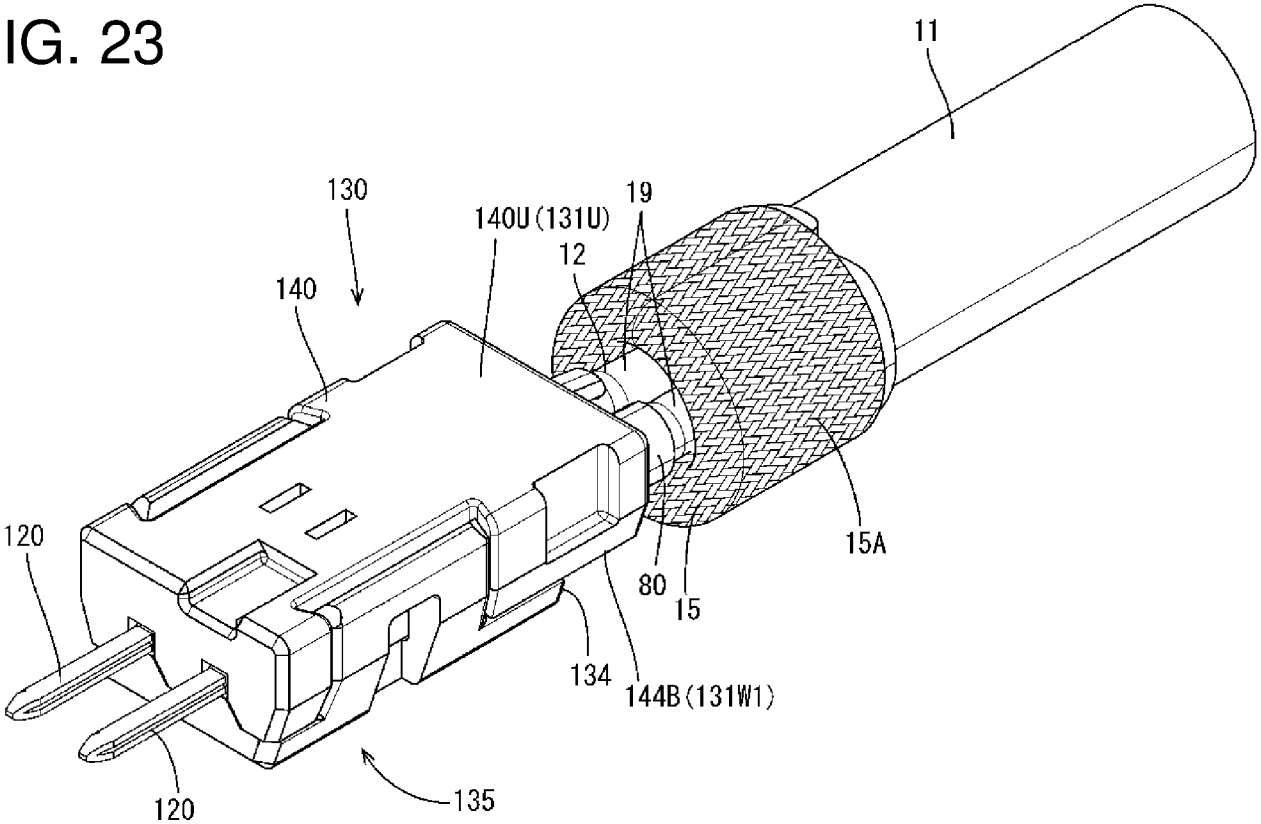
FIG. 23 is a perspective view showing a state where inner conductors and end parts of coated wires according to another embodiment are accommodated in a terminal accommodating member.
Figure 24:
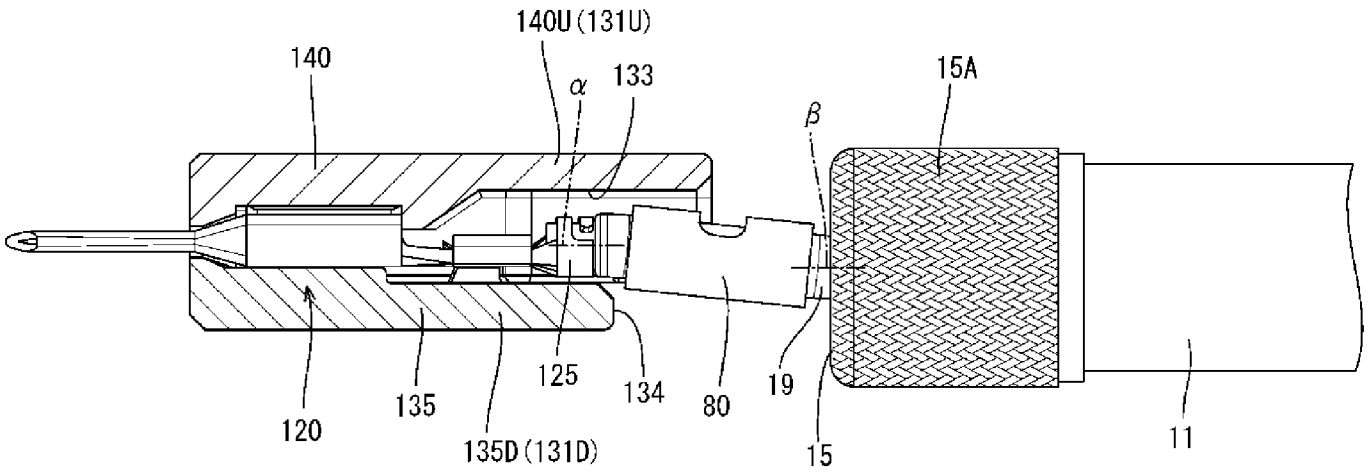
FIG. 24 is a section showing the state where the inner conductors and the end parts of the coated wires according to the other embodiment are accommodated in the terminal accommodating member.

(3) In the above embodiment, the inner conductors 20 constituted by female terminals are accommodated into the terminal accommodating member 30 composed of the lower member 35 and the upper member 40. However, without limitation to this, as shown in FIGS. 23 and 24, inner conductors 120 constituted by male terminals may be accommodated into a terminal accommodating member 130 composed of a lower member 135 and an upper member 140.

LIST OF REFERENCE NUMERALS

10: connector
11: shielded cable
12: coated wire
15: shield portion
16: sheath portion
17: linking portion
19: shield-side pull-out portion
20: inner conductor
25: inner conductor-side pull-out portion
30: terminal accommodating member
31: wall portion
31D: lower wall
34: wire insertion path
35: lower member (example of "first member")
40: upper member (example of "second member")
50: outer conductor
68: terminal module
70: housing
80: adjusting member (example of "covering member")

What is claimed is:

1. A terminal module, comprising:

a shielded cable including at least one coated wire, a conductive shield portion for covering an outer periphery of the coated wire and a sheath portion for covering an outer periphery of the shield portion;

an inner conductor to be connected to the coated wire;

an insulating terminal accommodating member for accommodating an end part of the coated wire together with the inner conductor; and an outer conductor to be fixed while being electrically connected to the shield portion as the terminal accommodating member is accommodated into the outer conductor, wherein:

an axis center of a shield-side pull-out portion for pulling out the coated wire in the shield portion is radially shifted with respect to an axis center of an inner conductor-side pull-out portion for pulling out the coated wire in the inner conductor, and a wire insertion path is formed in a part of a wall portion of the terminal accommodating member on a side toward which the axis center of the shield-side pull-out portion is shifted and a linking portion of the coated wire located between the inner conductor-side pull-out portion and the shield-side pull-out portion is insertable into the wire insertion path.

2. The terminal module according to claim 1, wherein:

a covering member for covering an outer periphery of the linking portion is mounted on the linking portion of the coated wire, and the linking portion covered by the covering member is insertable into the wire insertion path.

3. The terminal module according to claim 1, wherein:

the terminal accommodating member includes a first member having a first wall portion, the inner conductor and an end part of the coated wire being placed on the first wall portion, and a second member having a second wall portion for covering the inner conductor and the end part of the coated wire from a side opposite to the first wall portion of the first member, and the wire insertion path is formed by setting either one of the first and second wall portions to be shorter in an extending direction of the coated wire than the other.

4. A connector, comprising the terminal module and a housing for accommodating the terminal module;

wherein the terminal module, comprising:

a shielded cable including at least one coated wire, a conductive shield portion for covering an outer periphery of the coated wire and a sheath portion for covering an outer periphery of the shield portion;

an inner conductor to be connected to the coated wire;

an insulating terminal accommodating member for accommodating an end part of the coated wire together with the inner conductor; and an outer conductor to be fixed while being electrically connected to the shield portion as the terminal accommodating member is accommodated into the outer conductor, wherein an axis center of a shield-side pull-out portion for pulling out the coated wire in the shield portion is radially shifted with respect to an axis center of an inner conductor-side pull-out portion for pulling out the coated wire in the inner conductor, and a wire insertion path is formed in a part of a wall portion of the terminal accommodating member on a side toward which the axis center of the shield-side pull-out portion is shifted and a linking portion of the coated wire located between the inner conductor-side pull-out portion and the shield-side pull-out portion is insertable into the wire insertion path.

* * * * *